US007273262B2

(12) United States Patent
McGarry et al.

(10) Patent No.: US 7,273,262 B2
(45) Date of Patent: Sep. 25, 2007

(54) SYSTEM WITH ALIGNMENT INFORMATION

(75) Inventors: Mark McGarry, San Diego, CA (US); Robert Fogarty, San Diego, CA (US); Josep-Maria Serra, San Diego, CA (US); Ronald D. Stephens, Poway, CA (US); Kurt Thiessen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 260 days.

(21) Appl. No.: 10/875,975

(22) Filed: Jun. 23, 2004

(65) Prior Publication Data

US 2005/0285889 A1 Dec. 29, 2005

(51) Int. Cl.

| | |
|---|---|
| ***B41J 29/393*** | (2006.01) |
| ***B41J 29/38*** | (2006.01) |
| ***B41J 2/145*** | (2006.01) |
| ***B41J 2/16*** | (2006.01) |

(52) U.S. Cl. ..... 347/19; 347/5; 347/40; 347/49

(58) Field of Classification Search ..... 347/19
See application file for complete search history.

(56) References Cited

U.S. PATENT DOCUMENTS

| | | | | |
|---|---|---|---|---|
| 5,049,898 | A | 9/1991 | Arthur et al. | |
| 5,739,830 | A | 4/1998 | John et al. | |
| 5,847,722 | A | 12/1998 | Hackleman | |
| 6,019,449 | A | 2/2000 | Bullock et al. | |
| 6,039,430 | A | 3/2000 | Helterline et al. | |
| 6,068,415 | A | 5/2000 | Smolenski | |
| 6,196,652 | B1 | 3/2001 | Subirada et al. | |
| 6,298,783 | B1 | 10/2001 | O'Mera et al. | |
| 6,347,856 | B1 | 2/2002 | Arquilevich et al. | |
| 6,350,013 | B1 | 2/2002 | Scheffelin et al. | |
| 6,371,591 | B1 | 4/2002 | Conta et al. | |
| 6,390,588 | B1 * | 5/2002 | Ikeda | 347/19 |
| 6,450,614 | B1 | 9/2002 | Scheffelin et al. | |
| 6,554,390 | B2 | 4/2003 | Arquilevich et al. | |
| 6,561,613 | B2 | 5/2003 | Cunnagin et al. | |
| 6,568,782 | B1 | 5/2003 | Haselby | |
| 6,568,787 | B1 | 5/2003 | Girones et al. | |
| 6,715,854 | B2 | 4/2004 | Hall | |
| 6,764,155 | B2 * | 7/2004 | D'Souza et al. | 347/12 |

FOREIGN PATENT DOCUMENTS

| | | |
|---|---|---|
| EP | EP0858049 | 8/1996 |

OTHER PUBLICATIONS

European Search Report dated Apr. 13, 2007.

* cited by examiner

*Primary Examiner*—Matthew Luu
*Assistant Examiner*—Shelby Fidler

(57) ABSTRACT

A system includes a carrier, one or more printheads coupled with the carrier in a defined spatial relation, and alignment information associated with the carrier and identifying the defined spatial relation of one or more printheads.

14 Claims, 4 Drawing Sheets

SYSTEM WITH ALIGNMENT INFORMATION

BACKGROUND

Printing systems may employ carriers that include one or more printheads configured to deliver ink to media. To achieve placement of such delivered ink, printhead alignment may be determined, and appropriate adjustments to the firing patterns can be made. Printhead alignment may include, among other things, alignment of printheads relative to one another, and alignment of printheads relative to the carrier or media. Achieving printhead alignment may be time consuming.

DETAILED DESCRIPTION

Figure 1:
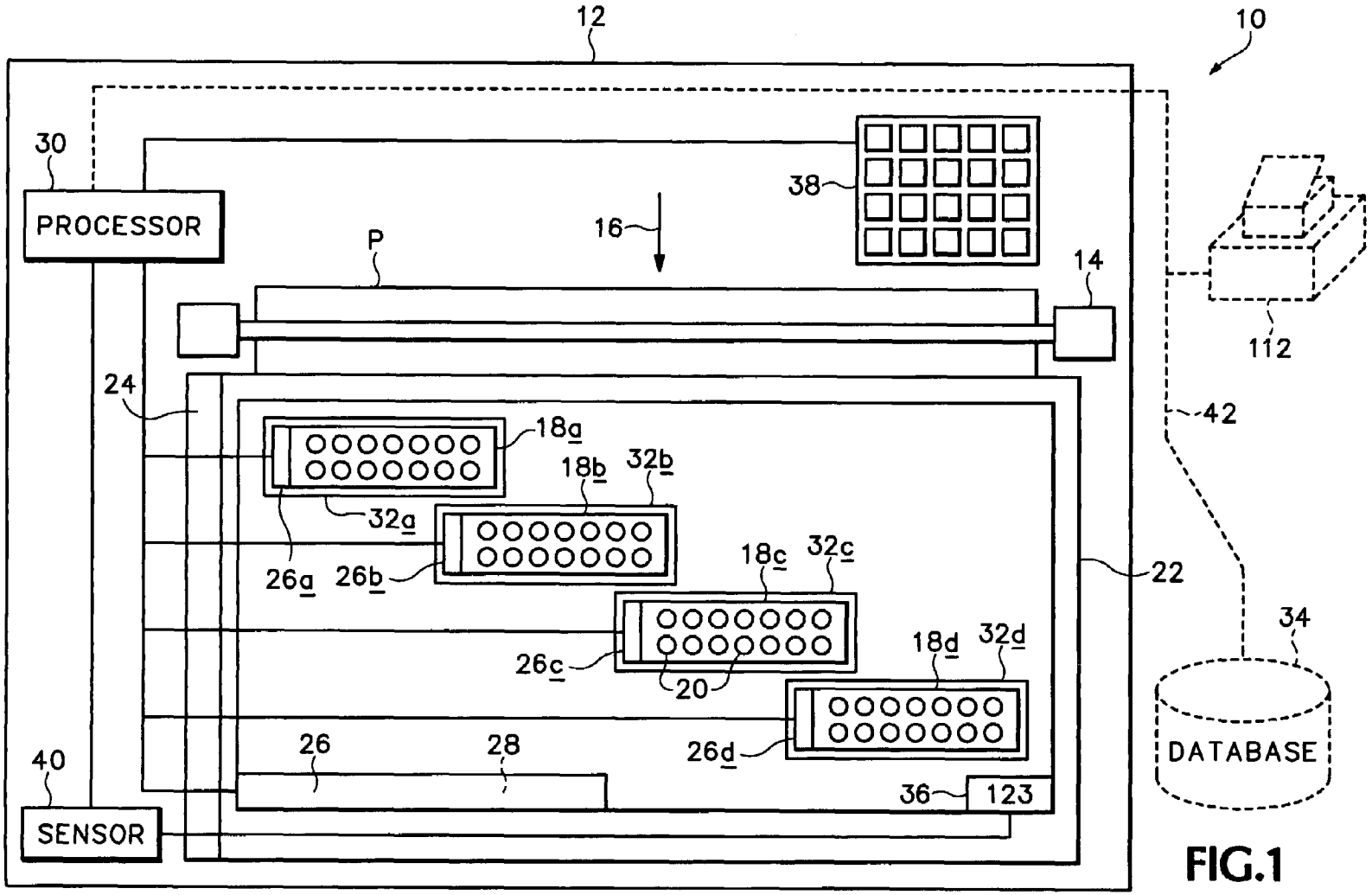
FIG. 1 is a schematic view of an embodiment of a printing system constructed in accordance with an embodiment of the invention.

Referring initially to FIG. 1, an exemplary embodiment of a printing system is shown schematically at 10. As shown, printing system 10 may include a printing device 12, which may be virtually any device suitable for use in depositing print fluid on print media. The printing device thus may employ a media advancement mechanism 14, which may direct media P along a feed path 16. Media P thus may be directed past printheads 18*a*-18*d*, and the printheads may be configured to deposit print fluid on the media, typically through plural nozzles 20 associated with each printhead.

Although FIG. 1 shows four printheads, it will be appreciated that any suitable number of printheads, or other print fluid ejection mechanisms may be employed. It also will be appreciated that each printhead may include associated structure for depositing print fluid on the media, such as ink supply systems, fluid pumping systems, etc.

Printheads 18*a*-18*d* may be housed in a printhead carrier 22, which may be removable from the printing device as a unit to accommodate rapid replacement of plural printheads. The carrier may take the form of a block, or other composite structure, and be selectively secured in place within the printing device 12 via printhead carrier support 24. The printhead carrier support may employ virtually any fastening mechanism, including brackets, frames, housings, and the like capable of receiving and/or being releasably coupled to one or more printhead carriers. Those fastening mechanisms may allow for a simple and quick fastening and/or release of printhead carrier 22 from printing device 12.

As indicated, printhead carrier 22 may define printhead stalls 32*a*-32*d*, which may be configured to contain printheads 18*a*-18*d*, respectively. Printhead stalls 32*a*-32*d* may include any suitable fastening mechanisms configured to retain printheads 18*a*-18*d*. Printhead stalls 32*a*-32*d* also may have any suitable arrangement in printhead carrier 22, and thus may define any suitable fixed spatial relationship of the printheads. For example, printhead stalls 32*a*-32*d* may be in parallel or staggered configuration. Furthermore, the printheads may be permanently maintained in their corresponding printhead stalls, or may be removable therefrom, or adjustable therein.

In accordance with the present teachings, the printhead carrier may include memory 26 configured to store alignment information 28 that identifies a defined spatial relation of one or more printheads coupled with printhead carrier 22. More particularly, the alignment information may include information on the relative positions of printheads 18*a*-18*d*. For example, alignment information may include offset information defining mechanical misalignment between two or more printheads 26. Offset information may include rotational offset information, Y-axis offset information, X-axis offset information, and/or any other suitable offset information relative to a reference position. Although alignment information between two or more printheads has been discussed, the scope of the disclosure includes alignment information between two or more nozzles, or any other suitable printing device components.

Based on the foregoing, it will be appreciated that alignment information 28 is associated with printhead carrier 22, and thus may be moved from printing device to printing device without performing an iterative determination of printhead alignment. It also will be appreciated that a printhead carrier may be placed in a printing device, and printing may begin, without performing an initial determination of printhead alignment. In some embodiments, memory 26 may take the form of nonvolatile memory, thereby permitting storage of the alignment information even when storing a printhead carrier outside of a printing device for extended periods of time.

The memory storing the alignment information may be dedicated memory of the printhead carrier, such as that shown at 26, or may form a part of memory used in connection with other operations of the printing device. For example, alignment information may be stored in memory associated with individual printheads of the printhead carrier, as indicated at 26*a*-26*d*. Furthermore, although memory 26 is shown as forming an integral part of printhead carrier 22, it will be appreciated that alignment information may be stored separately from the printhead carrier. For example, alignment information may be stored in a remote database 34, and accessed via a communications link such as the Internet. Although database 34 has been shown as separate from printing device 12, such database may be an integral part of the printing device.

Based on the foregoing, it will be appreciated that alignment information may be physically associated with a printhead carrier (as where the alignment information is stored in memory on the printhead carrier), or may be associated with the printhead carrier via an identifier 36 on the printhead carrier (as where the alignment information is stored in a database at a memory location corresponding to the identifier). Identifier 36 may take any suitable form, including for example, a physical code, an optical or magnetic code, or any other manner of presenting an identifier. Where the alignment information is stored in a database, the database may be a remote database accessible via a communications link, and/or may form a part of printing device 12 and/or printing system 10.

The printing device also may include a processor 30, which may be configured to direct operation of media advancement mechanism 14 and of printheads 18*a*-18*d*.

Accordingly, processor 30 may be in communication with memory 26 (and/or memory 26*a*-26*d*), thereby providing for access to alignment information 28 for use in directing operation of the printheads. Where the alignment information is stored in a remote database, such as database 34, the processor may be in communication with the database via a communications link 42, such as the Internet.

In some embodiments, where alignment information is stored in a database, such as database 34, an identifier, such as identifier 36, may be employed so as to accommodate access to alignment information for the proper printhead carrier. Where identifier 36 is a physical code, such as a numeric code, printing device 12 may be provided with a keypad 38 to allow the user to enter that code. For example, the user may read identifier 36 from the subject printhead carrier and communicate that identifier to processor 30 via a keypad 38. Thereafter, processor 30 may retrieve alignment information corresponding to the identifier from database 34. Alternatively, or additionally, printing device 12 may be provided with a suitable sensor 40 configured to read identifier 36, and communicate the identifier to processor 30.

Based on the retrieved alignment information, processor 30 may alter the firing times of one or more nozzles, may disable one or more nozzles, and/or may alter media feed. In general, the processor may be configured to access the alignment information, and to print in accordance with such alignment information. Printheads of a particular printhead carrier thus may be consistently aligned without re-determining alignment information each time the printhead carrier is loaded into a printing device.

As indicated generally in FIG. 1, printing system 10 also may include a printhead alignment device 112, which may be configured to determine spatial relationship of one or more printheads of a printhead carrier. Printhead alignment device 112 thus may be configured to receive printhead carrier 22 prior to placement of the printhead carrier in printing device 12. The printhead alignment device thus may be employed to determine spatial relationships of printheads of the printhead carrier, and to record the determined spatial relationships in association with the printhead carrier. Upon subsequent placement of the printhead carrier in printing device 12, the recorded spatial relationships may be accessed by the printing device, and the printing device may print based on the recorded spatial relationship.

Figure 2:
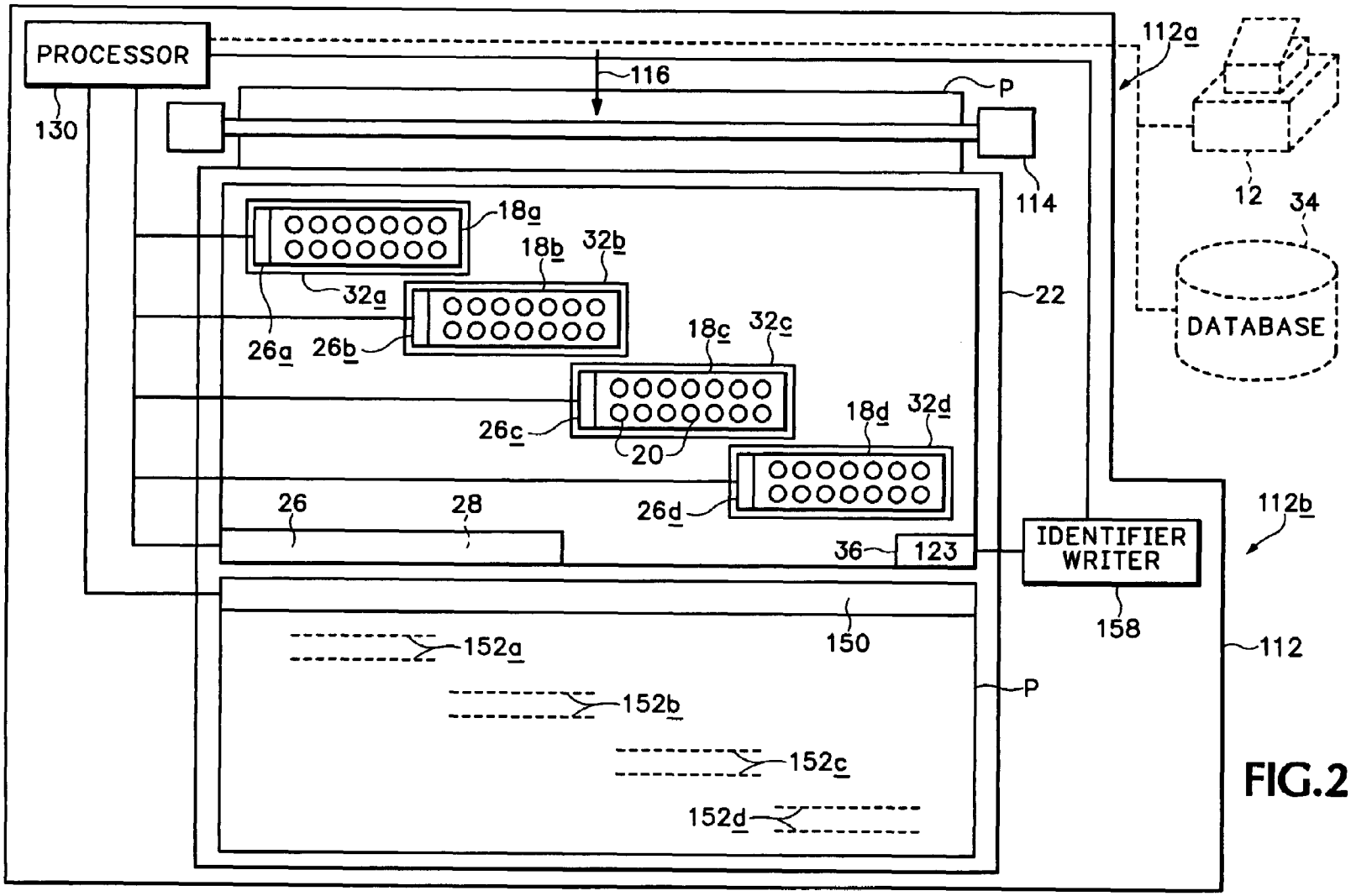
FIG. 2 is a schematic view of an embodiment of a printhead alignment system, including an offline scanning device and a remote database according to an embodiment of the invention.

Referring now to FIG. 2, it will be noted that printhead alignment device 112 may include a receiving device 112*a* configured to receive the printhead carrier, and to define an alignment pattern indicative of spatial relationship of the plurality of printheads. More particularly, receiving device 112*a* may take the form of a printing device configured to print one or more alignment patterns using the printheads of printhead carrier 22. Such alignment patterns may be printed on media P upon passage of the media along a feed path 116 by advancement mechanism 114.

As indicated, printhead alignment device 112 also may include a scanning device 112*b* configured to view the alignment pattern defined by the printheads of the printhead carrier. For example, the scanning device may employ a scanner 150 configured to view one or more alignment patterns 152*a*-152*d* printed by printheads 18*a*-18*d* of the printhead carrier 22. Alignment information thus may be determined based on the viewed alignment patterns. Alternatively, or additionally, the scanning device may employ a scanner configured to view the printheads themselves, and to determine alignment information based on the viewed positions of the printheads, or of the nozzles on the printheads. Once determined, alignment information may be associated with the printhead carrier, as described in detail above.

More particularly, relative positions of the plurality of printheads may be determined by a processor 130 based on the alignment pattern viewed by the scanning device, and corresponding spatial relationships may be recorded in memory associated with the printhead carrier. The memory may be incorporated into the printhead carrier, as indicated at 26, may be incorporated into one or more of the printheads, as indicated at 26*a*-26*d*, or may be remote from the printhead carrier, such as database 34. Although scanner processor 130 is described herein as determining the relative positions of the printheads based on the viewed alignment patterns, it will be appreciated that the scope of the disclosure includes embodiments where processor 30 either shares or completely performs that functionality.

Once the spatial relationships are recorded, the printhead carrier may be transferred to printing device 12, or another printing device, for printing. As described above, printing device processor 30 may be configured to access the spatial relationships (which may be stored, for example, as alignment information), and to print with the printheads based on the accessed spatial relationships. Such access may be achieved via a communications link to the printhead carrier, and/or via a communications link to a remote database, depending on where the spatial relationships are stored.

Printing system 10 thus may include a printhead alignment device 112 configured to determine the spatial relationship of printheads on a subject printhead carrier and to record such spatial relationship in association with the subject printhead carrier, and a printing device 12 configured to receive the subject printhead carrier and to print based on the spatial relationship associated with such printhead carrier.

Printhead alignment device 112 may include a first printer configured to receive any of plural printhead carriers, and to print one or more alignment pattern indicative of the spatial relationship of printheads on the subject printhead carrier. Printhead alignment device 112 also may include a scanner configured to view the alignment pattern, to determine the spatial relationship of the printheads based on the viewed alignment pattern, and to record the determined spatial relationship in association with the subject printhead carrier. As described above, the spatial relationship may be recorded as alignment information, and may be stored in memory on the printhead carrier (or the printheads of the subject printhead carrier), or may be stored in a remote database.

Printing device 12 may take the form of a second printer, which may be configured to receive the subject printhead carrier, as indicated, and to access the recorded spatial relationship for the subject printhead carrier. The second printer thus may print with the printheads of the subject printhead carrier (which remain in fixed relation to one another, even as the printhead carrier moves from printer to printer) based on the recorded spatial relationship. It will be appreciated that the spatial relationship may include an offset of at least one printhead relative to a reference position, and that the second printer may be configured to adjust targeting of incoming print directives to at least one printhead by the offset.

As described above, the recorded spatial relationship may be accessed directly, where the spatial relationship is stored in memory integral with the subject printhead carrier (or integral with one or more printheads of the subject printhead carrier). Alternatively, where alignment information is stored in a remote database, the spatial relationship may be accessed via a communications link, such as the Internet, using an appropriate identifier of the subject printhead carrier. The printhead alignment device thus may include a writer 158, which may be configured to place an identifier on the printhead carrier for use in matching the printhead carrier to proper alignment information upon use of the printhead carrier in the second printer. The second printer thus may be configured to identify the identifier of the subject printhead carrier, thereby accommodating access of the spatial relationship of the subject printhead carrier.

In some embodiments, the first printer and scanner may be combined in a single, multi-functional device. In other embodiments, the first printer and scanner may be distinct devices. Similarly, the second printer may be combined with a scanner, and/or may merge with the first printer to accomplish all of the aforementioned tasks.

Figure 3:
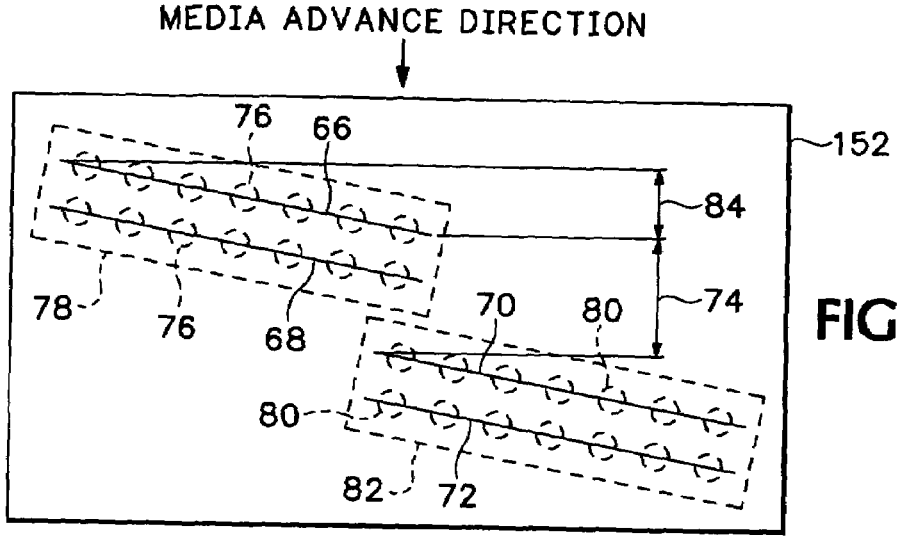
FIGS. 3-5 are schematic views demonstrating an exemplary method of obtaining alignment information using the embodiment of the offline scanning device depicted in FIG. 2.
Figure 4:
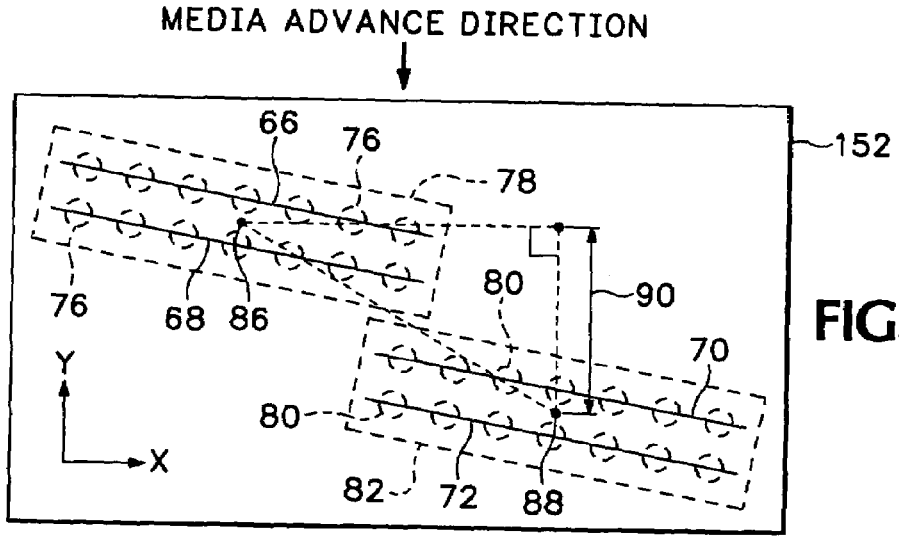
Figure 5:
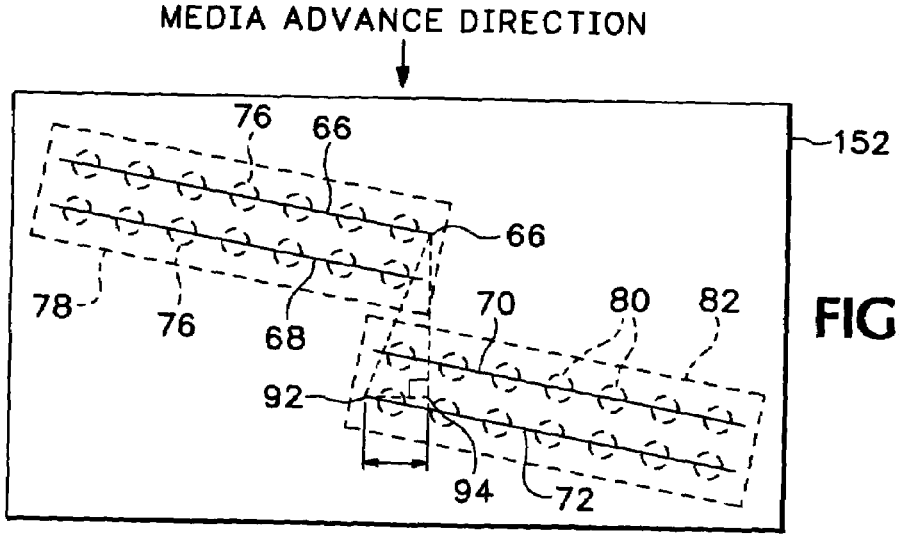

Processor 30 and/or processor 130 may analyze scanned information in various ways and obtain various types of alignment information 28. For example, FIGS. 3-5 schematically illustrate an embodiment of analyzing scanned information to obtain rotational, Y-axis, and X-axis offset information. Alignment pattern 152, for example, may include four solid lines, 66, 68, 70, and 72, and a vertical reference line 74. Solid lines 66 and 68 may be printed from nozzles 76 from a first printhead 78, while solid lines 70 and 72 may be printed from nozzles 80 from a second printhead 82, and vertical reference line 74 may be printed by at least one of the nozzles from the second printhead.

In FIG. 3, rotational offset information may be obtained by measuring a rotational offset distance 84 on vertical reference line 74. In FIG. 4, Y-axis offset information may be obtained by calculating centers 86 and 88 and measuring Y-axis offset distance 90 between those centers. In FIG. 5, X-axis offset information may be obtained by calculating an intersection point 92 from solid lines 66 and 72, and measuring X-axis offset distance between end 92 of solid line 72 and intersection point 94.

Figure 6:
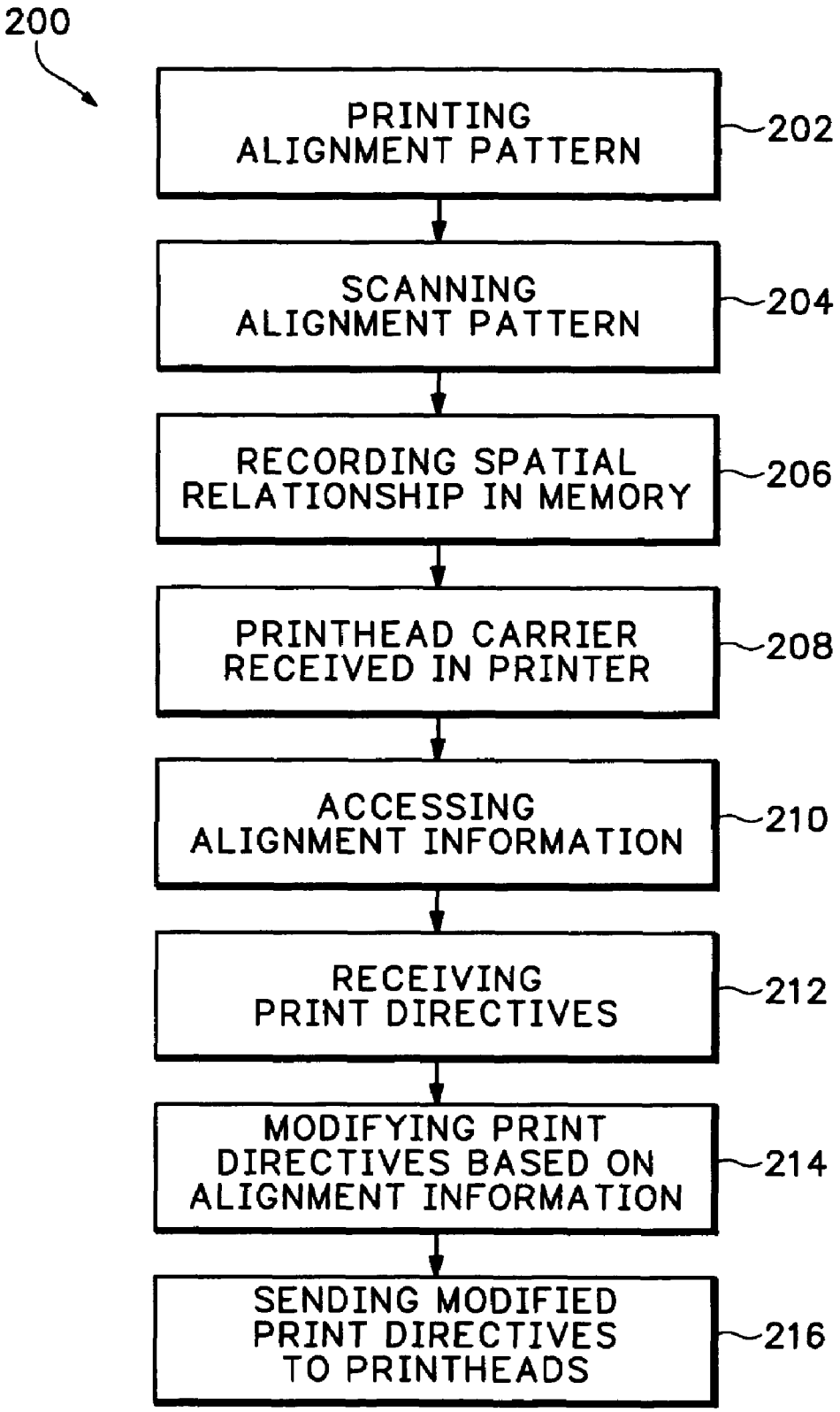
FIG. 6 is a flowchart illustrating an exemplary printing method that involves alignment of one or more printheads in accordance with an embodiment of the invention.

FIG. 6 is a flowchart 200 illustrating an embodiment of a printing method, which may be employed by the printing system described herein. As indicated the exemplary method includes printing an alignment pattern with printheads of a subject printhead carrier, at 202; scanning the alignment pattern to determine spatial relationship of the printheads, at 204; and recording the determined spatial relationship in memory associated with the printhead carrier, at 206. Such spatial relationship may be recorded in memory as alignment information, and the memory may be integral with the printhead carrier, or may form a part of a remote database, as described above.

Upon recording the spatial relationship, the printhead carrier may be received in a printer, at 208, and a further printing operation may begin. As indicated the exemplary further printing operation may include accessing alignment information that identifies relative positions of plural printheads mounted on a carrier, at 210; receiving print directives, at 212; modifying the print directives based on the alignment information, at 214; and sending the modified print directives to the one or more printheads to effect printing, at 216. Accessing alignment information may include identifying the printhead carrier, and selecting alignment information corresponding to the carrier. Modifying the print directives may include adjusting targeting of print directives to at least one printhead by an offset identified relative to a reference position.

Although the present disclosure has been provided with reference to the foregoing operational principles and embodiments, it will be apparent to those skilled in the art that various changes in form and detail may be made without departing from the spirit and scope defined in the appended claims. The present disclosure is intended to embrace all such alternatives, modifications, and variances. Where the disclosure or claims recite "a," "a first," or "another" element, or the equivalent thereof, they should be interpreted to include one or more such elements, neither requiring nor excluding two or more such elements.

What is claimed is:

1. A printing system comprising:

a first printer configured to receive a subject printhead carrier of plural printhead carriers, each printhead carrier including an identifier and mounting a plurality of printheads in fixed relation to one another, the first printer being configured to print an alignment pattern indicative of the spatial relationship of printheads on the subject printhead carrier;

a scanner configured to view the alignment pattern to determine the spatial relationship of printheads on the subject printhead carrier, and to record a determined spatial relationship in association with the identifier of the subject printhead carrier;

a second printer configured to receive the subject printhead carrier, to access the determined spatial relationship associated with the identifier of the subject printhead carrier, and to print with the printheads on the subject printhead carrier based on the determined spatial relationship associated with the subject printhead carrier; and memory containing determined spatial relationships of printheads on each of plural printhead carriers, wherein the second printer is further configured to read the identifier of the subject printhead carrier, access a location in the memory that is associated with the identifier of the subject printhead carrier, and retrieve the determined spatial relationship in the accessed memory location, thereby accommodating printing with printheads of various printhead carriers based on the determined spatial relationship associated with such printhead carriers.

2. The printing system of claim 1, wherein the determined spatial relationship includes an offset of at least one printhead relative to a reference position, and wherein the second printer is further configured to adjust targeting of incoming print directives to the at least one printhead by the offset.

3. The printing system of claim 1, further comprising a writer configured to place an identifier on the subject printhead carrier.

4. The printing system of claim 1, wherein the memory is included in a database accessible by the second printer via a communications link.

5. A printing method comprising:

accessing alignment information which identifies relative positions of printheads mounted on a carrier, wherein accessing alignment information includes reading an identifier of the carrier, accessing in memory a location that is associated with the identifier, and retrieving alignment information in the accessed memory location;

receiving print directives;

modifying the print directives based on the alignment information; and sending the modified print directives to the printheads to effect printing.

6. The printing method of claim 5, which further comprises recording the alignment information in association with the identifier of the carrier, the alignment information being accessible by a printer including the carrier.

7. The printing method of claim 6, wherein recording the alignment information includes recording the alignment information in memory included on the carrier.

8. The printing method of claim 6, wherein recording the alignment information includes recording the alignment information in a database accessible by the printer via a communications link.

9. The printing method of claim 5, wherein the alignment information includes an offset of at least one printhead relative to a reference position, and wherein modifying the print directives includes adjusting targeting of print directives to the at least one printhead by the offset.

10. The printing method of claim 5, which further comprises:

printing an alignment pattern with the printheads;

scanning the alignment pattern to determine a spatial relationship of the printheads on the carrier; and recording the determined spatial relationship as alignment information for the carrier, the alignment information being stored in association with the identifier of the carrier.

11. A printing method comprising:

printing an alignment pattern with a plurality of printheads, the printheads being mounted on a printhead carrier having an identifier;

scanning the alignment pattern to determine a spatial relationship of the printheads;

recording the determined spatial relationship in memory associated with the identifier of the printhead carrier;

receiving the printhead carrier in a printer;

accessing memory to identify the spatial relationship of the printheads on the received printhead carrier including reading an identifier of the received printhead carrier, accessing a location of the memory that is associated with the identifier of the received printhead carrier, and retrieving a recorded spatial relationship in the accessed memory location;

receiving print directives;

modifying the print directives based on the identified spatial relationship of the printheads; and sending the modified print directives to the printheads to effect printing.

12. The printing method of claim 11, wherein recording the spatial relationship includes recording the spatial relationship in a database accessible by the printer via a communications link.

13. The printing method of claim 11, wherein the alignment information includes an offset of at least one printhead relative to a reference position, and wherein modifying the print directives includes adjusting targeting of print directives to the at least one printhead by the offset.

14. The printing method of claim 11, further comprising placing the identifier on the printhead carrier.

* * * * *